US007808360B1

(12) United States Patent
Le et al.

(10) Patent No.: US 7,808,360 B1
(45) Date of Patent: Oct. 5, 2010

(54) CUSHIONING MATERIALS AND METHOD FOR APPLYING THE SAME TO RESIN CAST TRANSFORMERS

(75) Inventors: Hoan D. Le, Wendell, NC (US); Steve A. Shaw, Greenville, NC (US); Libor Ruprecht, Pozorice (CZ)

(73) Assignee: ABB Technology AG, Zurich (CH)

( * ) Notice: Subject to any disclaimer, the term of this patent is extended or adjusted under 35 U.S.C. 154(b) by 333 days.

(21) Appl. No.: 11/312,820

(22) Filed: Dec. 20, 2005

Related U.S. Application Data

(60) Provisional application No. 60/637,539, filed on Dec. 20, 2004.

(51) Int. Cl.
*H01F 27/24* (2006.01)

(52) U.S. Cl. ..... 336/229; 336/207; 336/198

(58) Field of Classification Search ..... 336/229
See application file for complete search history.

(56) References Cited

U.S. PATENT DOCUMENTS

| | | | | |
|---|---|---|---|---|
| 2,222,729 | A | 12/1936 | Planck at al. | |
| 2,382,199 | A | 8/1945 | Brink | |
| 2,464,568 | A * | 3/1949 | Flynn et al. | 336/96 |
| 3,587,168 | A | 6/1971 | Kolator | |
| 4,019,167 | A | 4/1977 | Barker | |
| 4,523,171 | A | 6/1985 | Altmann et al. | |
| 5,361,057 | A * | 11/1994 | Ito et al. | 336/198 |
| 5,656,984 | A * | 8/1997 | Paradis et al. | 336/61 |
| 6,381,834 | B1 | 5/2002 | May | |
| 6,980,076 | B1 * | 12/2005 | Rolling et al. | 336/207 |

FOREIGN PATENT DOCUMENTS

| | | |
|---|---|---|
| DE | 2024931 | 12/1971 |
| JP | 2001048020 A * | 2/2001 |

OTHER PUBLICATIONS

Eng. Abstract of DE2024931, Dec. 2, 1971, Fried Krupp GmbH.

* cited by examiner

*Primary Examiner*—Elvin G Enad
*Assistant Examiner*—Joselito Baisa
(74) *Attorney, Agent, or Firm*—Paul R. Katterle

(57) ABSTRACT

A resin cast transformer having a core covered by a cushioning material is provided. The cushioning material is in contact with the core and includes a force absorption layer adjoining a force distribution layer. The force distribution layer is harder than the force absorption layer.

16 Claims, 4 Drawing Sheets

CUSHIONING MATERIALS AND METHOD FOR APPLYING THE SAME TO RESIN CAST TRANSFORMERS

CROSS-REFERENCE TO RELATED APPLICATION

This application claims the benefit of U.S. provisional patent application No. 60/637,539 filed on Dec. 20, 2004, which is hereby incorporated by reference in its entirety.

BACKGROUND OF THE INVENTION

This invention relates to a cushioning material and a method for applying the same to a core-coil assembly of a resin cast transformer.

The basic building block of a transformer is the metal magnetic core. The core can generally be made out of a stack of metal laminations or sintered metal powder. The most common core shapes are rectangular and ring-like. In order to achieve a high degree of accuracy and efficiency in the finished transformer, it is important that the magnetic properties of the core are maintained throughout the manufacturing processes.

One type of material used in manufacturing transformer laminated cores, is grain oriented silicon steel. During the manufacturing process for the core, the grain of the steel is groomed as much as possible to flow in one direction. This is to allow optimum current sensitivity. By having the grain of the steel aligned in one direction, the maximum magnetic field loss is at its lowest value. With the magnetic field loss at its lowest level, the transformer's sensitivity to current flow is at its highest level, which means that the transformer has the highest response in current flow measurement.

When the transformer is assembled and packaged, an electrically insulating resin material is used to seal, that is, encapsulate, the components including the core and the coil wound thereon. The encapsulating resin provides electrical, mechanical and environmental protection to the core-coil assembly and allows safe handling of the transformer. The encapsulating resin is typically a thermoset polymer or resin, which is a polymer material that cures, through the addition of energy, to a stronger form. The energy may be in the form of heat (generally above 200 degrees Celsius), through a chemical reaction, or irradiation. A thermoset resin is usually liquid or malleable prior to curing, which permits the resin to be molded. When a thermoset resin cures, molecules in the resin cross-link, which causes the resin to harden. After curing, a thermoset resin cannot be remelted or remolded, without destroying its original characteristics. Thermoset resins include epoxies, malamines, phenolics and ureas.

When a thermoset resin cures, the resin typically shrinks. Because the resin surrounds the core, the shrinking thermoset resin exerts high mechanical stresses and strains on the grain oriented silicon steel core of the transformer. These stresses and strains distort the oriented grains and increase resistance to the magnetic flux flow in the laminations. This distortion and increased resistance results in higher core loss which causes the sensitivity of the transformer to decrease and diminishes the accuracy of the transformer. In addition, when the thermoset resin shrinks around a sharp protrusion, cracks typically form in the resin. The cracks may grow over time and compromise the seal that the resin provides to the internal components of the transformer.

Several prior art methods have been developed to protect a transformer core from the foregoing problems caused by shrinking resin. These methods include:

(a) wrapping the core with solid rubber cushions that are specially molded to fit snuggly around the core; and (b) enclosing the core in a molded plastic "core cup" that isolates the core from the shrinking resin.

However, both of the above methods of protecting the core from the stresses and strains arising from the shrinking resin are expensive since each core has to have a uniquely molded boot or cup. If there is a slight variation in the size of the core, the boot or cup does not properly fit around the core and thus the boot or cup provides ineffective protection.

It would therefore be desirable, to provide a transformer with an improved cushioning material which protects a core/coil assembly of the transformer from the stresses imparted by the shrinking of a thermoset resin used to encapsulate the core/coil assembly and which helps preserve the integrity of the thermoset resin. The present invention is directed to such a cushioning material and a method for applying the same to a core-coil assembly of a resin cast transformer.

SUMMARY OF THE INVENTION

In accordance with the present invention, a transformer is provided and includes a metal core and primary and secondary windings disposed around the core. A cushioning material is in contact with the core and includes a force absorption layer adjoining a force distribution layer. The force distribution layer is harder than the force absorption layer. A dielectric resin encapsulates the core, the primary and secondary windings and the cushioning material.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
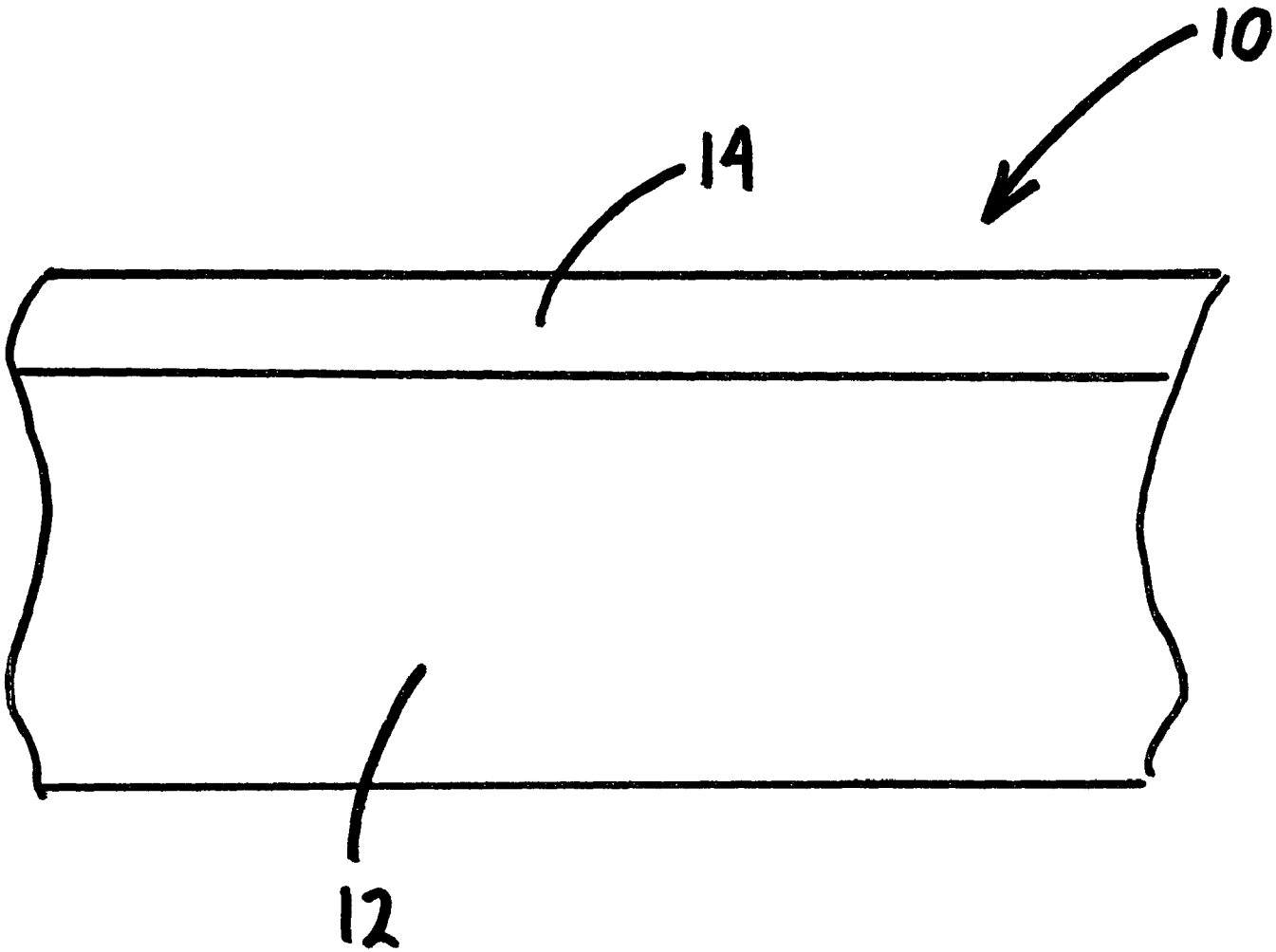
FIG. 1 shows a partial schematic view of a cushioning material embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

The present invention is directed to a cushioning material 10 that is wrapped around a core and/or coils of a transformer in the manner described below. As shown in FIG. 1, the cushioning material 10 is electrically insulating and comprises a force absorption layer 12 adjoining a force distribution layer 14. The force distribution layer 14 is comprised of a web of cellulosic material, such as pressboard or presspaper, which are typically formed from wood pulp and/or cotton fibers. The force absorption layer 12 is comprised of a polymeric foam, such as a closed cell thermoset polymer foam. The force distribution layer 14 is harder than the force absorption layer 12. In one embodiment, the force absorption layer 12 is an ethylene-propylene-nonconjugated diene (EPDM) foam having a hardness ranging from 40-70 Shore 00 durometer and the force distribution layer 14 is a low density pressboard backing having a thickness ranging from about 0.020 inches to about 0.080 inches. The foam thickness varies depending on how much shrinkage occurs when the resin cures and also the size limit of the transformer and thus the foam thickness may, for example, range from about 0.125 inches to about 1.0 inches.

The force absorption layer 12 may be attached to the force distribution layer 14 by an adhesive. The adhesive is selected to match resin processing temperatures that may reach up to 130° C. for a short period of time. The adhesive may be in the form of a transfer tape, such as 3M 969 adhesive transfer tape, or may be a liquid.

Figure 3:
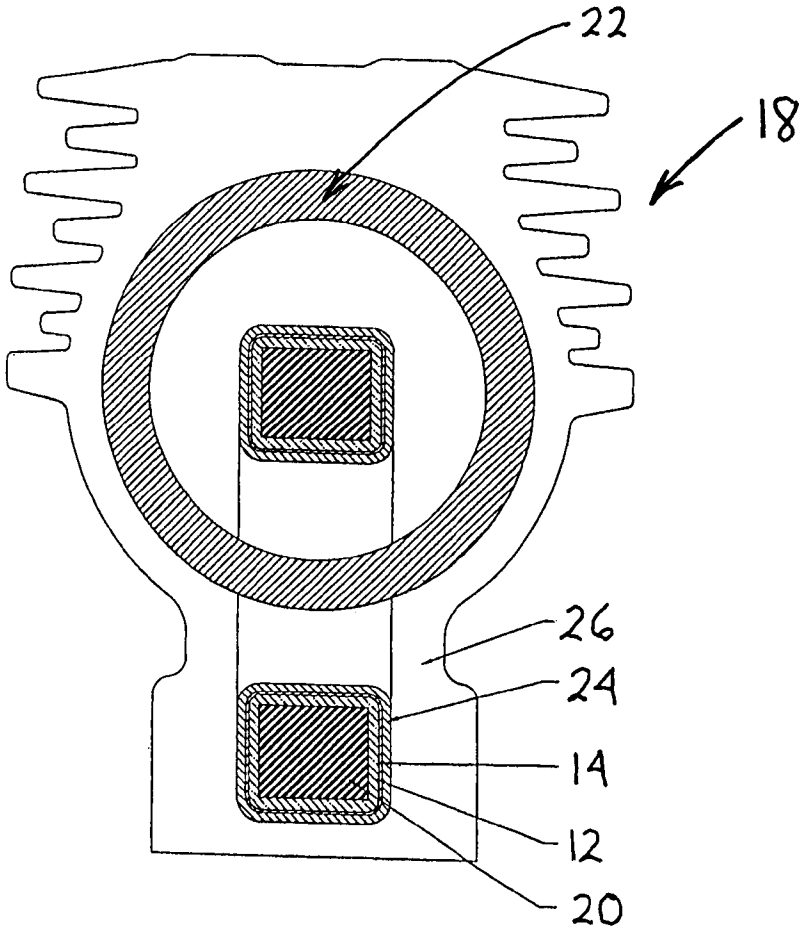
FIG. 3 shows a front sectional of the first transformer.
Figure 2:
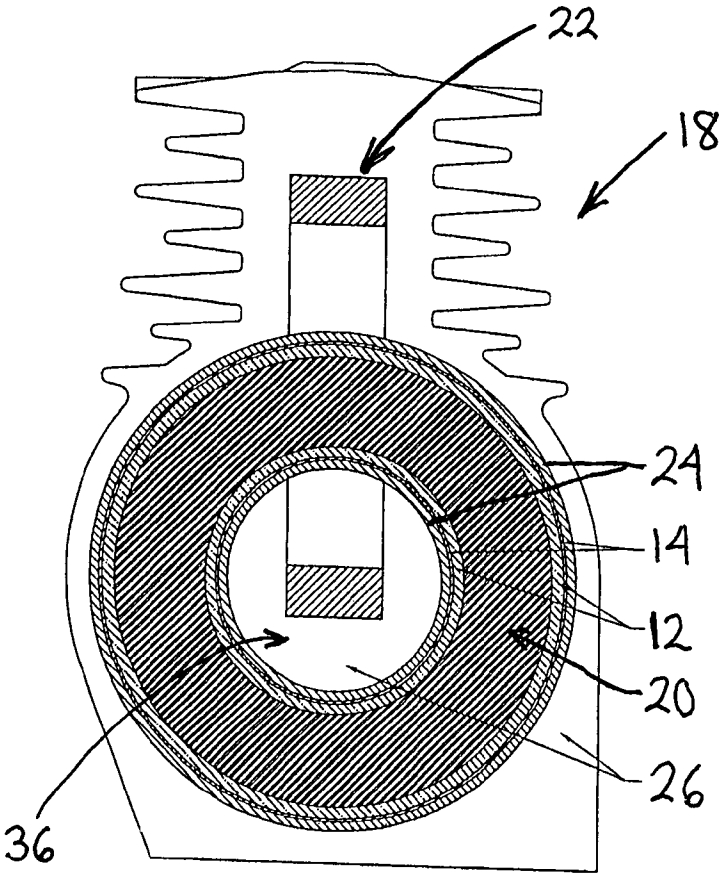
FIG. 2 shows a side sectional view of a first transformer having the cushioning material disposed around a core.

Referring now to FIGS. 2 and 3, there are respectively shown side and front sectional views of a transformer 18 that generally includes the cushioning material 10, a core 20, a primary winding 22 and a secondary winding 24. The core 20 is comprised of metal and is annular in shape. The secondary winding 24 is wound around the core 20, while the primary winding 22 is connected to the core 20 so as to be interlinked therewith. The core 20, the primary winding 22, the secondary winding 24 and the cushioning material 10 are encapsulated in a dielectric resin 26, which is an epoxy cast resin. The transformer 18 is an instrument transformer and more specifically, a current instrument transformer. Instrument transformers are used in measurement and protective applications, together with equipment, such as meters and relays. An instrument transformer "steps down" the current or voltage of a system to a standardized value that can be handled by associated equipment. For example, a current instrument transformer may step down current in a range of 10 to 2,500 amps to a current in a range of 1 to 5 amps, while a voltage instrument transformer may step down voltage in a range of 12,000 to 40,000 volts to a voltage in a range of 100 to 120 volts.

Figure 4:
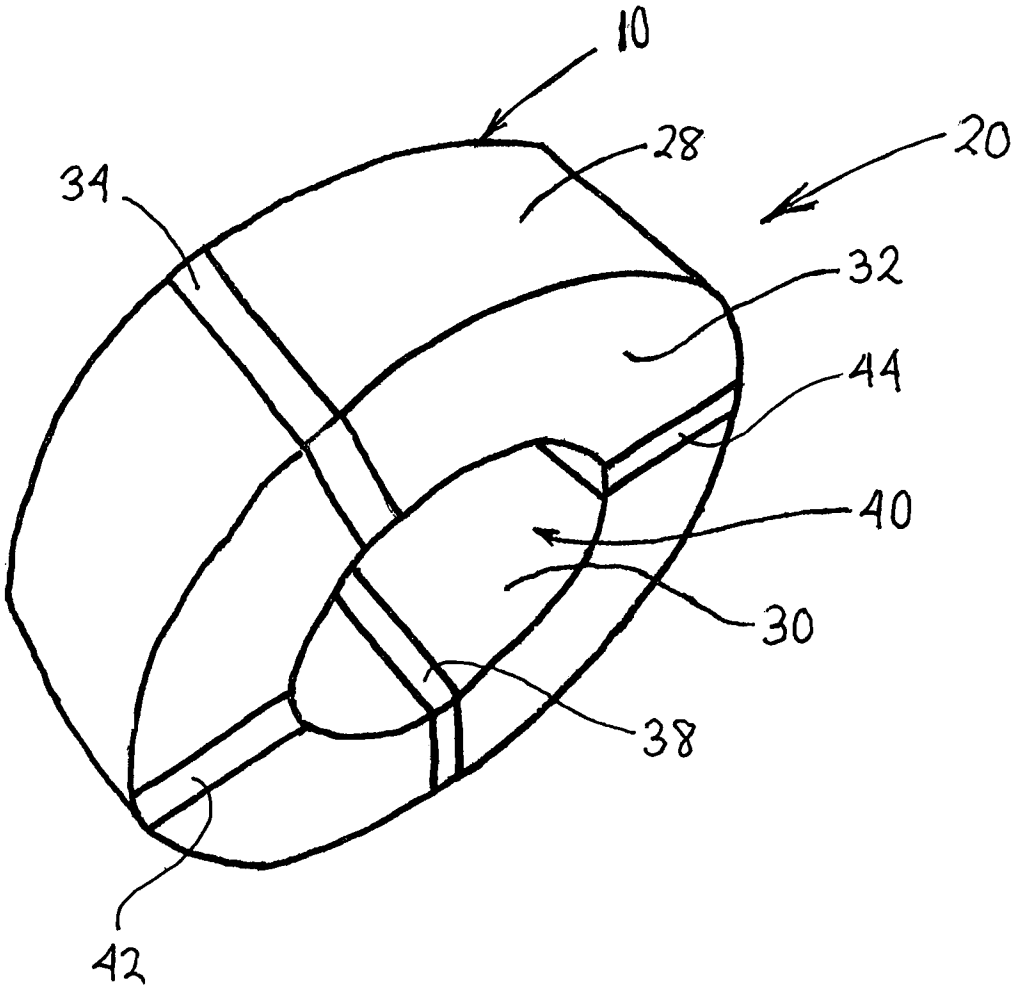
FIG. 4 shows a top perspective view of the core of the first transformer with the cushioning material disposed therearound.

The cushioning material 10 is disposed on the core 20 such that the force absorption layer 12 is in direct contact with the core 20 and the force distribution layer 14 is facing outwardly. As shown in FIG. 4, the cushioning material 10 may be applied in four different pieces 28, 30, 32 and a fourth piece, which is not shown. The piece 28 is elongated and rectangular and is disposed around an outer circumference of the core 20. Opposing ends of the piece 28 are held together by a tape band 34. The piece 30 is also elongated and rectangular, but is shorter than the piece 28. The piece 30 is disposed around the circumference of a central opening 36 in the core 20. Opposing ends of the piece 30 are held together by a tape band 38. The piece 32 and the fourth piece are each annular in shape and have a central opening 40. The piece 32 and the fourth piece are disposed over opposing faces of the core 20 such that their central openings 40 are aligned with the central opening 36 in the core 20. The piece 32 and the fourth piece are secured to the pieces 28 and 30 by the tape bands 34, 38 and by tape bands 42, 44.

After the cushioning material 10 is secured to the core 20, the secondary winding 24 is wound over the cushioning material 10, with the secondary winding 24 being in direct contact with the force distribution layer 14. In this manner, the cushioning material 10 is disposed between the core 20 and the secondary winding 24.

After the secondary winding 24 is wound over the cushioning material 10 and the primary winding 22 is interlinked with the core 20, the resulting assembly is disposed in a mold. The dielectric resin 26 (in liquid form) is added to the mold and then cured so as to encapsulate the assembly. Any localized force applied to the cushioning material 10 as a result of the curing and shrinking of the dielectric resin 26 is distributed by the force distribution layer 14 over its entire surface. This allows the force absorption layer 12 underneath the force distribution layer 14 to absorb the force over a larger area, thus keeping the core 20 from experiencing any type of stress and strain arising from the shrinking dielectric resin 26.

Figure 5:
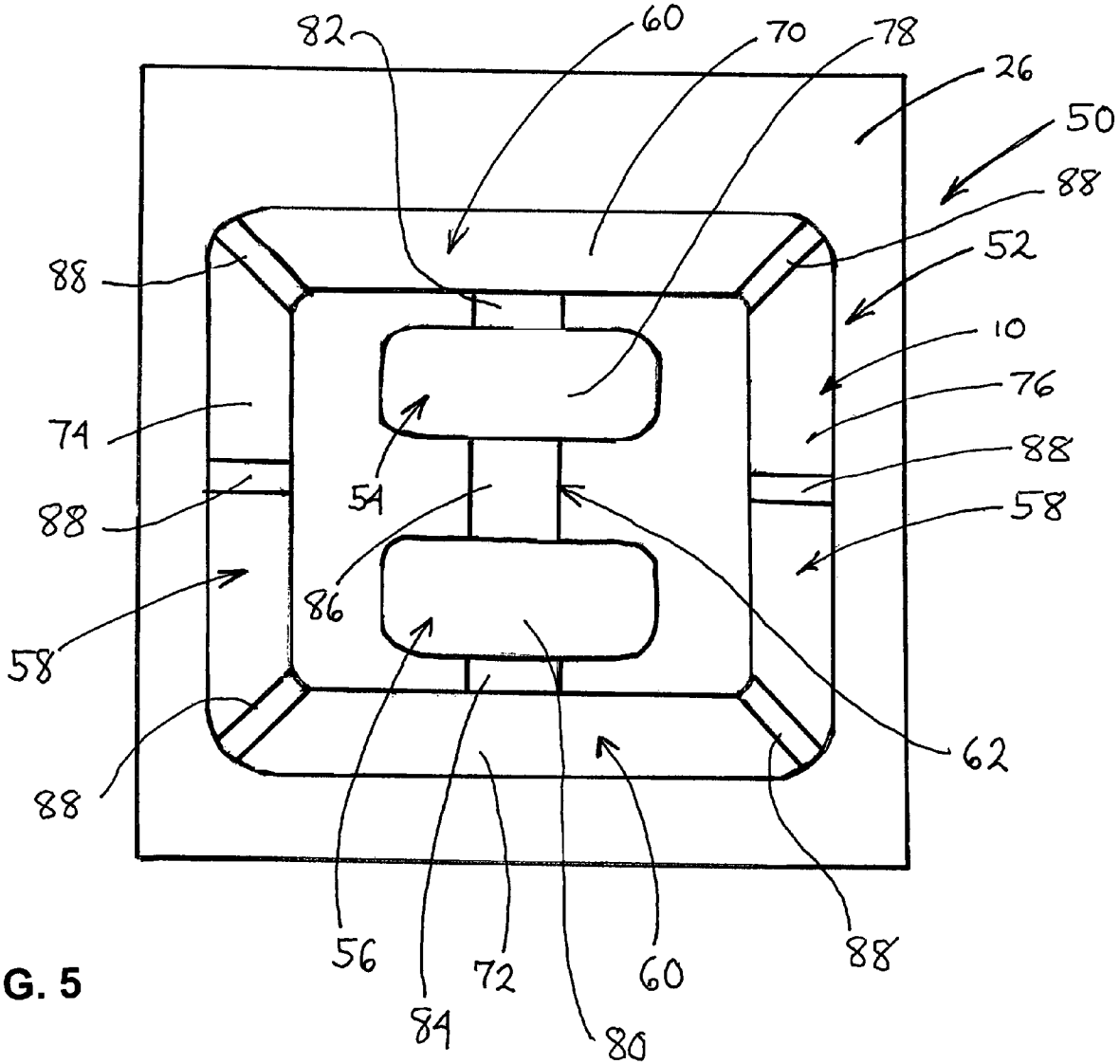
FIG. 5 shows a schematic view of a second transformer having the cushioning material disposed around a core.

Referring now to FIG. 5, there is shown a transformer 50 comprising the cushioning material 10, a core 52, primary and secondary winding 54, 56. The transformer 50 is a voltage instrument transformer. The core 45 is comprised of metal and is generally rectangular in shape. The core 52 includes a pair of outer legs 58 extending between a pair of yokes 60. An inner leg 62 also extends between the yokes 60 and is disposed between and substantially evenly spaced from the outer legs 58. The primary and secondary windings 54, 56 are disposed around the inner leg 62.

As in the transformer 18, the cushioning material 10 is disposed on the core 52 such that the force absorption layer 12 is in direct contact with the core 52 and the force distribution layer 14 is facing outwardly. The cushioning material 10 is provided in a plurality of pieces, such as pieces 70, 72, 74, 76, 78, 80, 82, 84, 86. The pieces 70, 72 are disposed at least partly around the yokes 60, respectively, while the pieces 74, 76 are disposed at least partly around the outer legs 58. The pieces 70-76 may be secured to the core 52 by tape bands 88. The pieces 70-76 cover at least the exterior faces and outer edges of the yokes 60 and the outer legs 58. The inner faces of the yokes 60 and the outer legs 58 may be left uncovered. The pieces 78, 80 are disposed around the outer circumferences of the primary and secondary windings 54, 56 respectively. The piece 82 is disposed around the inner leg 62, between the primary winding 54 and one of the yokes 60, while the piece 84 is disposed around the inner leg 62, between the secondary winding 56 and the other one of the yokes 60. The piece 86 is disposed around the inner leg 62, between the primary and secondary windings 54, 56.

The pieces 70-86 are mounted to the core 52 so as to cover the edges of the yokes 60, the outer legs 58 and the inner leg 62 and other sharp protrusions. In this manner, the cushioning material 10 helps provide the core 52 and the primary and secondary windings 52, 54 with smooth surfaces to be surrounded by the dielectric resin 26.

After the cushioning material 10 and the primary and secondary windings 52, 54 are mounted to the core 52 as described above, the resulting core/coil assembly is disposed in a mold and encapsulated in the dielectric resin 26. Any localized force applied to the cushioning material 10 as a result of the curing and shrinking of the dielectric resin 26 is distributed by the force distribution layer 14 over its entire surface. This allows the force absorption layer 12 underneath the force distribution layer 14 to absorb the force over a larger area, thus keeping the core 52 from experiencing any type of stress and strain arising from the shrinking dielectric resin 26. Moreover, since the cushioning material 10 covers all of the sharp protrusions in the core/coil assembly, the shrinking dielectric resin 26 will not crack.

In the transformer 18, 50, the dielectric resin 26 may be molded to form an outer housing for the transformer 18, 50, as is shown in FIGS. 2, 3 and 5. Alternately, an outer housing separate from the dielectric resin may be provided and disposed around the dielectric resin 26.

In summary, the cushioning material 10 is applied to a core 10, 52 as follows:

The force absorption layer 12 (closed cell foam) is first attached to the force distribution layer 14 by means of an adhesive. The adhesive can be a liquid type or a transfer film type, such as the 3M 969 tape, as long as the adhesive properties develop fast enough for the intended application process.

The cushioning material 10 can now be cut and trimmed into pieces to fit the dimensions of the disc or cylindrical or rectangular core. The trimmed cushioning material 10 pieces are applied onto the core 20, 52 using a suitable adhesive (liquid or transfer tape) with the force absorption layer 12 in firm contact with the magnetic core 20, 52. The order of how the pieces are applied to the core 20, 52 is not critical as long as the entire core 20, 52 is covered up with these pieces of cushioning material 10.

The cushioned magnetic core 20, 52 is now ready for assembling into the core-coil assembly for the transformer 18, 50.

While the present invention is described herein as the combination of an EPDM foam and a pressboard having a certain range of thickness it should be appreciated that the foam may any elastomeric (rubber) foam such as neoprene, nitrile butyl rubber, styrene-butadiene rubber, silicone rubber, etc. It should be appreciated that while a pressboard having a thickness of about 0.020 inches to about 0.080 inches allows the padding of the present invention to be flexible for wrapping the transformer core, a padding with a thicker pressboard is also within the scope of the present invention even though a padding with a thicker pressboard may require more effort to apply to the transformer core and other transformer components.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A transformer comprising:

a metal core;

primary and secondary windings disposed around the core;

a cushioning material in contact with the core and disposed between the core and the secondary winding, said cushioning material comprising a force absorption layer adjoining a force distribution layer, said force distribution layer being thinner and harder than said force absorption layer and being comprised of non-metallic material, and said force absorption layer being in contact with the core; and a dielectric resin encapsulating the core, the primary and secondary windings and the cushioning material.

2. The transformer of claim 1, wherein the force distribution layer and the force absorption layer are composed of different materials.

3. The transformer of claim 2, wherein the force distribution layer is comprised of a web of cellulosic material.

4. The transformer of claim 3, wherein the web of cellulosic material is pressboard.

5. The transformer of claim 3, wherein the force absorption layer is comprised of a polymeric foam.

6. The transformer of claim 5, wherein the polymeric foam is a closed cell thermoset polymer foam.

7. The transformer of claim 5, wherein the dielectric resin comprises an epoxy resin.

8. The transformer of claim 2, wherein the force distribution layer is in contact with the secondary winding.

9. The transformer of claim 2, wherein the transformer is an instrument transformer.

10. The transformer of claim 2, wherein the core is annular and the secondary winding is wound over the cushioning material and around the core.

11. The transformer of claim 10, wherein the primary winding is annular and is interlinked with the core.

12. The transformer of claim 11, wherein the force distribution layer is comprised of a web of cellulosic material and the force absorption layer is comprised of a polymeric foam.

13. The transformer of claim 2, wherein the force absorption layer is secured to the force distribution layer by adhesive.

14. The transformer of claim 2, wherein the cushioning material is disposed between the core and the primary winding.

15. The transformer of claim 2, wherein the core is rectangular and includes an inner leg disposed between a pair of outer legs, and wherein the primary and secondary windings are mounted to the inner leg.

16. The transformer of claim 15, wherein the force distribution layer is comprised of a web of cellulosic material and the force absorption layer is comprised of a polymeric foam.

* * * * *